United States Patent [19]

Lai

[11] Patent Number: 4,581,961

[45] Date of Patent: Apr. 15, 1986

[54] ADJUSTABLE SCREW DRIVER

[76] Inventor: Min D. Lai, 2 F, No. 6, Lane 608, Wen-Hua Rd., Section 2, Panchiao, Taiwan

[21] Appl. No.: 779,460

[22] Filed: Sep. 24, 1985

[51] Int. Cl.[4] ..... B25B 23/00

[52] U.S. Cl. ..... 81/439; 81/438

[58] Field of Search ..... 81/439, 438

[56] References Cited

U.S. PATENT DOCUMENTS 2,674,286 4/1954 Carson ..... 81/439

*Primary Examiner*—Frederick R. Schmidt
*Assistant Examiner*—J. T. Zatarga
*Attorney, Agent, or Firm*—Sheridan Neimark

[57] ABSTRACT

An adjustable screw driver having an improved structure, and more particularly to an adjustable screw driver with a detachable shank having two different tips, a symmetrically-grooved handle on which a flute is set for disposing a wire spring which is attached to the handle by a screw at one end and associated with a control plate by its other end through an aperture of the plate having a square engaging hole at the center. A piece of restraining board having a cut on its periphery is fixed to the bottom of the handle by screws. A shank which has one side partically toothed is disposed through the central opening of restraining board and the engaging hole of control plate then into a shank-receiving tunnel inside the handle right after the control plate is pushed upward by one of its end so to make the central opening and the engaging hole as well as the tunnel line collinearly for reception of the shank which can be adjusted of its length by engaging proper tooth with the engaging hole for various working conditions.

5 Claims, 4 Drawing Figures

ADJUSTABLE SCREW DRIVER

SUMMARY OF THE INVENTION

An improved screw driver which is capable of adjusting its length according to various working reguirements by using a shank which has engaging teeth consecutively disposed on one of us sides and is inserted into a shank receiving tunnel inside a handle and held firmly in place by a control plate when one side of the square engaging hole is wedged in one of the teeth.

The shanks of commonly available screw drivers can be either fixed as one to the handle or removably attached thereto, the former can deal with only one type of screw each time with fixed tip, the latter is more available owing to its flexibilty of attaching different shank for different type of screw, and the subject matter having its shank equipped with two different tips and its length adjustable further increases the practicality of common screw driver.

It is obvious a problem which confronted by most people when using a screw driver to reach a spot just out of the reach of the shank, and in view of this, the inventor intends to provide a means for adjusting the length of shank according to working conditions.

The first object of the present invention is to provide an adjustable screw driver which takes advantage of a control plate having a rectangular engaging hole through which a shank having a plurality of engaging teeth is disposed, and the length of the shank can be freely adjusted when the side of the rectangular engaging hole is wedged between different engaging teeth.

The second object of the present invention is to provide an adjustable screw driver which takes advantage of a wire spring exerting resilient force on the control plate so to make the side of the engaging hole firmly and strongly engaged with the engaging teeth and prevent it from shaking or loosening in operation.

The further object of the present invention is to provide an adjustable screw driver which has a restraining board on the periphery of which a cut is disposed in view of easy operation of the control plate.

The feature, structure and operation of the present invention become clear with the description of the accompanying drawing as below:

Name of component:

1—handle
12—shank receiving tunnel
14—head
16—spring-fixing screw
18—screw hole
21—tip
3—restraining plate
32—screw mounting hole
34—cut
41—engaging hole

11—flute
13—control plate receiving groove
15—bottom
17—wire spring
2—shank
22—tooth
31—screw
33—square opening
4—control plate
42—aperture

DETAILED DESCRIPTION

Figure 1:
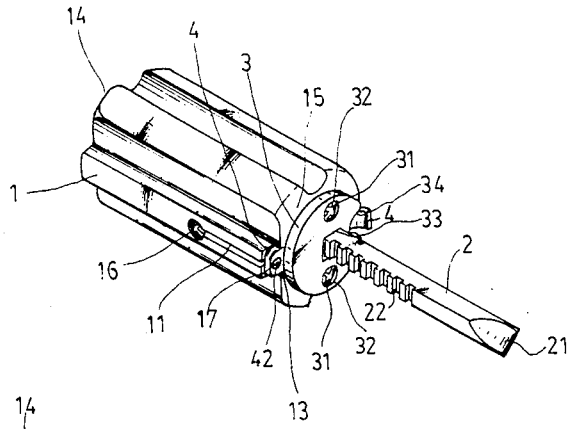
FIG. 1 is a view of the assembly of the subject matter.
Figure 2:
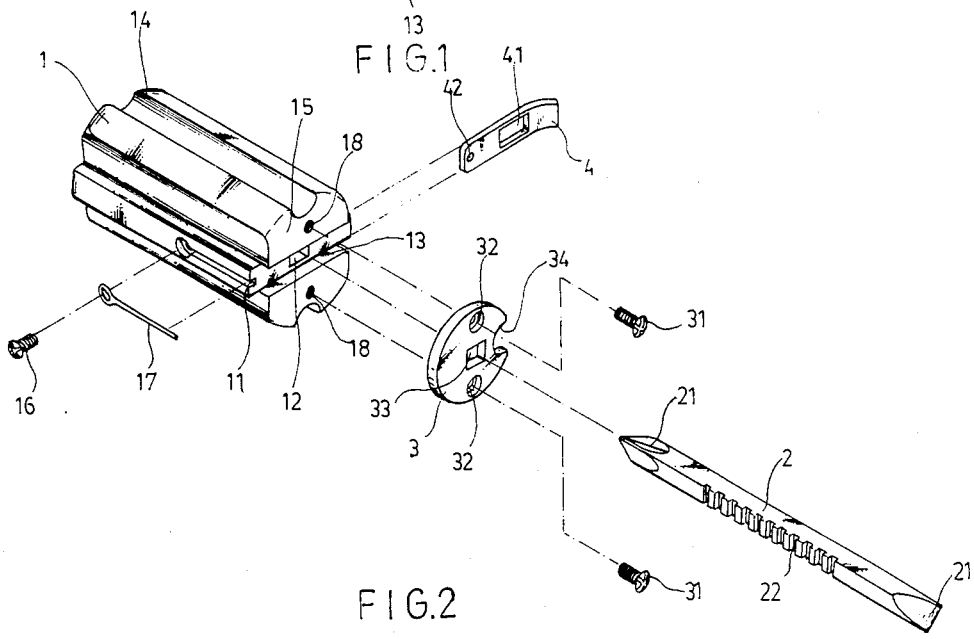
FIG. 2 is a view of the exploded components of the subject matter.

Referring to FIG. 1 and FIG. 2, the present invention comprises a handle 1, a shank 2, a restraining board 3, a control plate 4, and the handle 1 is symmetrically grooved from head 14 to bottom 15 all around for easy grasp; a flute 11 which begins from the edge of the bottom and ends in the middle of the handle 14 with a screw hole is disposed for housing a wire spring 17 fixed therein by a screw 16 and extending into a rectangular control plate receiving groove 13 and engaging with said control plate 4 by setting its other end in an aperture 42 thereof; right at the center of said handle 1, a shank-receiving tunnel 12 is disposed for accession of said shank 2 with two different tips, and on said bottom 15 there are two symmetric screw holes 18 set about said tunnel for attaching said restraining board 3 thereto; said control plate 4 movable along said groove 13 having an said aperture 42 for accession of one end of said wire spring 17 so to enable said control plate to retractably move from right to left owing to the resilience of said wire spring 17, and at the center of said control plate there is a rectangular engaging hole 41 which is just as wide as the shank 2 for tight engagement, and for easy operation of said control plate, the other end opposing the end with an apperture is slightly upward bended; the said restraining board 3 is a circular one with a central square opening 33 which corresponds to the size of said shank 2 as well as the mouth of said tunnel 12, and two screw mounting holes 32 with screw head sinking bore are disposed for attaching said restraining board 3 thereto; and a cut 34 on the periphery of restraining board 3 is specially set in consideration of easy operation of said control plate 4; and a plurality of engaging teeth 22 in cooperation with said control plate 4 to rigidly joint the shank to said handle.

To assemble the said screw driver is very simple, by first fixing said wire spring 17 in said flute 11 on said handle 1 by screws 16, and secondly putting the protruding end of the wire spring 17 into said aperture 42 of said control plate 4 locating in the groove 13, and finally screwing said restraining board down to said bottom 15 of said handle 1 by screws 31 locating in screw holes 18 so that the control plate is confinedly disposed therebetween.

Figure 3:
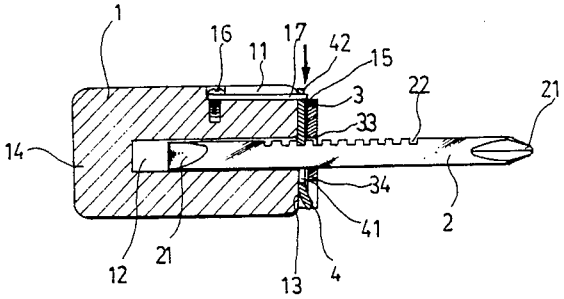
FIG. 3 is a sectional view of the assembled screw driver.
Figure 4:
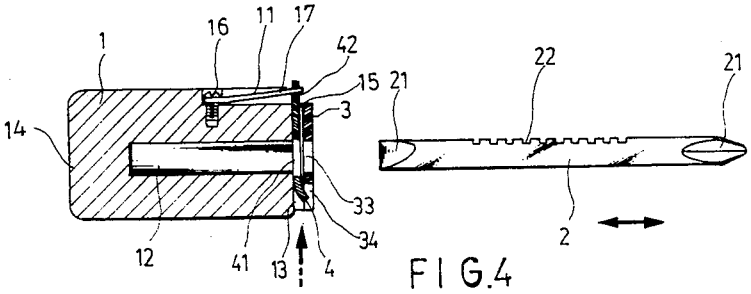
FIG. 4 is the sectional view of the subject matter with the engaging plate being pushed up to release the toothed shank.

Referring continuously to FIGS. 3 and 4, the centers of said engaging hole 41 of the control plate 14 and of said central square opening 33 of the restraining board 3 are not collinearly disposed after assembling together so that said shank 2 with square cross section can't get through the above said openings until the slightly bended end of said control plate is pushed upward as shown in FIG. 4 to make the engaging hole 41 and the square opening 33 as well as the tunnel 12 collinearly located with their centers, and the one side toothed shank 2 is smoothly located in the tunnel 12 and firmly attached to said handle 1 by wedging said engaging hole 41 in between one pair of the teeth 22 when the control plate is released assumming its original position due to the resilient force of said wire spring 17. The length of the screw driver is adjustable with ease according to different requirements of working conditions.

The merits of the subject matter is briefly summarized in the following:

1. The length of the screw driver can be adjusted to facilitate its use in different working conditions.

2. The manufacturing and assembly of the screw driver is simple and economic in cost.

3. The shank can be firmly attached to said handle without loosening or shaking in operation.

What I claim is:

1. An improved adjustable screw driver comprising:

a shank having two tips and a plurality of engaging teeth disposed consecutively on one of its sides;

a handle having a control plate receiving groove across the central portion of its bottom, and two screw holes symmetrically located on two sides of said groove, and a shank receiving tunnel set right at the center of said bottom of said handle, and a plurality of grasping grooves symmetrically set around said handle;

a wire spring fixed to said handle in a flute by screwing down one end of it thereto with the other end projecting out of said flute but not excessing the bottom of said handle;

a restraining board having a central opening for the passage of said shank, and two screw mounting holes having screw head sinking bore disposed symmetrically to said opening, and a cut on its periphery, attached to said bottom of said handle by said screws, a control plate movably located in a control plate receiving groove having an aperture for receiving one said end of said wire spring, and a rectangular engaging hole disposed with its center sightly eccentric of the center of said plate, and a slightly bended end for easy operation;

a shank having two tips and a plurality of consecutively disposed engaging teeth.

2. An improved adjustable screw driver as claimed in claim 1 having a plurality of grasping grooves which is formed in U-shape.

3. An improved adjustable screw driver as claimed in claim 1 having an attachable shank which can be in square, triangular or circular shape of its cross section.

4. An improved adjustable screw driver as claimed in claim 1 having a said restraining board which can have a central opening shaped in square, triangular or circular form.

5. An improved adjustable screw driver as claimed in claim 1 having a said control plate which can have its eccentric engaging hole shaped in square, triangular or circular form.

* * * * *